US006734407B1

(12) United States Patent
Abbott

(10) Patent No.: US 6,734,407 B1
(45) Date of Patent: May 11, 2004

(54) APPARATUS FOR SUSPENDING A COVERING OVER A CONTAINER IN A MICROWAVE OVEN

(76) Inventor: William D. Abbott, 4037 E. Delta Cir., Mesa, AZ (US) 85206

( * ) Notice: Subject to any disclaimer, the term of this patent is extended or adjusted under 35 U.S.C. 154(b) by 114 days.

(21) Appl. No.: 10/043,353

(22) Filed: Jan. 8, 2002

(51) Int. Cl.[7] ..... H05B 6/80
(52) U.S. Cl. ..... 219/732; 219/762
(58) Field of Search ..... 219/732, 762, 219/734, 725, 763, 735, 752; 150/154; 126/29, 30, 9 R, 25 A; 99/421 H, 425, 444–450

(56) References Cited

U.S. PATENT DOCUMENTS 3,067,737 A * 12/1962 Brown ..... 126/274
4,064,797 A * 12/1977 Forlani ..... 99/341
D260,221 S 8/1981 Lee et al.
4,291,775 A * 9/1981 Collins ..... 374/14
4,343,978 A 8/1982 Kubiatowicz
4,516,923 A * 5/1985 Lifshitz et al. ..... 425/289
4,924,049 A 5/1990 Dexter, Jr.
5,714,740 A 2/1998 Kelly et al.
6,131,560 A * 10/2000 Healy ..... 126/30

* cited by examiner

*Primary Examiner*—Quang T. Van
(74) *Attorney, Agent, or Firm*—Schmeiser, Olsen & Watts, LLP

(57) ABSTRACT

An apparatus adapted to suspend a covering over a container in a microwave oven is disclosed. A center beam is supported by multiple support members each having a first and a second leg. The first end of each leg rests on the floor of the oven, and these leg ends are spaced apart so as to accommodate a container underneath the apparatus. The second end of each leg is positioned at ajunction location along with the center beam. The legs are adjustable in length so as to accommodate microwave ovens and containers of varying sizes. A covering is placed over the apparatus to prevent food splatters and to improve heating results. The apparatus may include a clip or other holder which serves to secure the covering to the apparatus. The entire apparatus may be disassembled for ease of storage or shipment.

13 Claims, 4 Drawing Sheets

APPARATUS FOR SUSPENDING A COVERING OVER A CONTAINER IN A MICROWAVE OVEN

BACKGROUND OF THE INVENTION

1. Technical Field

This invention generally relates to an apparatus for use in a microwave oven, and more specifically relates to an apparatus for suspending a covering over a container in a microwave oven.

2. Background Art

Since their widespread commercial introduction more than thirty years ago, microwave ovens have become an increasingly common feature of the kitchen. Over 90 percent of American homes, for example, contain microwave ovens, which heat foods by subjecting them to electromagnetic radiation in the form of microwaves. The microwave region of the electromagnetic spectrum falls below the visible band and the infrared region in terms of both frequency and energy. The microwave region includes frequencies between about 1,000 and 300,000 megahertz, but the microwaves generated by microwave ovens are confined to a frequency of 2,450 MHz.

The radiation these appliances generate is absorbed by water, fat, and other molecules in food, causing the molecules to vibrate and produce heat. Because the heating occurs inside the food, eliminating the need to raise the temperature of the surrounding air, microwave ovens drastically reduce cooking and heating times. If during this process a food's water molecules are heated to the boiling point, the resulting pressure can be great enough to forcefully propel food particles throughout the microwave oven's interior. Foods with a skin or a coating, like popcorn or eggs, may even explode. Because of the speed with which microwave ovens raise temperatures, food splatters like this are a common occurrence.

The usual approach to preventing food splatters, when this is even attempted, is to place a covering like a paper towel or a napkin on the food container to act as a shield. When this is done, moisture from the food, as well as food particles themselves, can penetrate the covering and leave a soggy mess to be dealt with. A covering in direct contact with the food can also trap moisture in the food that would otherwise escape, leading to food that is mushy and less appealing to the eye and to the palate.

Some containers have their own lids that may be used to contain food splatters. Similarly, covers made of plastic or other substance that does not absorb moisture may be used as splatter shields. But while these solutions may work well in some limited contexts, they do not prevent splattering when food is heated on a plate, or any generally flat container lacking structure on which a lid or other covering may rest.

DISCLOSURE OF INVENTION

Therefore, there existed a need to provide a way to reliably prevent food splatter in a microwave oven without compromising the quality or appearance of the food, and without the need for a container with structure to support a lid. According to the present invention, an apparatus is adapted to suspend a covering over a container in a microwave oven. A center beam is supported by multiple support members each having a first and a second leg. The first end of each leg rests on the floor of the oven, and these leg ends are spaced widely apart so as to accommodate a container underneath the apparatus. The second end of each leg is positioned at ajunction location along with the center beam. The legs are adjustable in length so as to accommodate microwave ovens as well as containers of varying sizes. The apparatus may include a clip or other holder which serves to secure the covering to the apparatus. The entire apparatus may be disassembled for ease of storage or shipment.

In use, each support member is joined to the center beam at the junction locations and spaced from the neighboring support members so as to provide balance and stability to the apparatus. The length of the legs of each support member is then adjusted so that the apparatus fits as desired inside the microwave oven. In one configuration the apparatus is capable of accommodating containers up to nearly the limit which the microwave will admit. After placing the apparatus in the oven, the user drapes a covering over the center beam and support members such that the covering substantially covers the apparatus. An optional clip may be used to secure the covering to the apparatus. A container is then positioned underneath the apparatus and the microwave oven operated in the usual manner.

The covering apparatus described herein thus provides a convenient, inexpensive way to reduce or prevent food splatters in a microwave oven while avoiding the problems of excess moisture retention by the food, water transfer to the covering, and covering slippage or displacement.

The foregoing and other features and advantages of the invention will be apparent from the following more particular description of selected embodiments of the invention, as illustrated in the accompanying drawings.

BRIEF DESCRIPTION OF DRAWINGS

Selected embodiments of the present invention will hereinafter be described in conjunction with the appended drawings, where like designations denote like elements.

MODES FOR CARRYING OUT THE INVENTION

According to the present invention, an apparatus is adapted to suspend a covering over a container in a microwave oven. A center beam is supported by multiple support members each having a first and a second leg. The first end of each leg rests on the floor of the oven, and these first leg ends are spaced apart so as to accommodate a container underneath the apparatus. The second end of each leg is positioned at ajunction location along with the center beam. The legs are adjustable in length so as to accommodate microwave ovens and containers of varying sizes. The apparatus may include a clip or other holder which serves to secure the covering to the apparatus. The entire apparatus may be disassembled for ease of storage or shipment.

Figure 1:
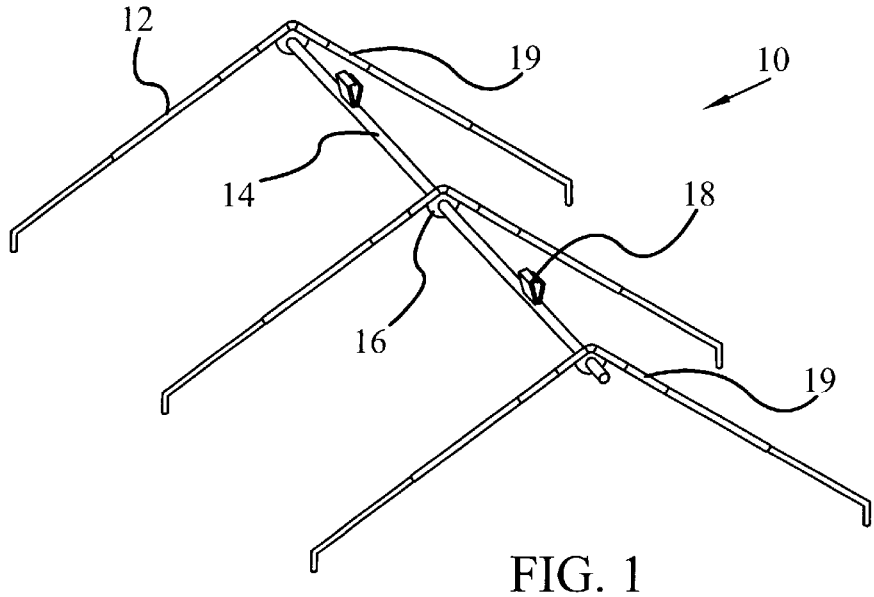
FIG. 1 is a perspective view of the present invention.

Referring now to the figures, and in particular to FIG. 1, an apparatus 10 for use in conjunction with heating food in a microwave oven includes a plurality of support members 12 connected to a center beam 14 at junction locations 16.

In one embodiment of apparatus 10, center beam 14 may include a holding device 18. In another embodiment, support members 12 may include a friction surface 19.

Support members 12, center beam 14, and holding devices 18 are made of a material that may safely be used inside a microwave oven. Plastic is a material that works well, but those skilled in the art will recognize that there are many other materials that could be used in its place. Center beam 14 is a substantially straight component that may advantageously be cylindrical but that could also have a rectangular, triangular, square or other cross section. Center beam 14 is much longer in one dimension than it is in its other dimensions, and may be hollow or solid. It should here be stated that the number of holding devices 18 may vary from zero up to any number desired. The fact that holding devices 18 will frequently, as here, be referred to in a plural sense should not be understood to mean that apparatus 10 requires more than one, or indeed, any particular number of, holding devices 18.

Figure 3:
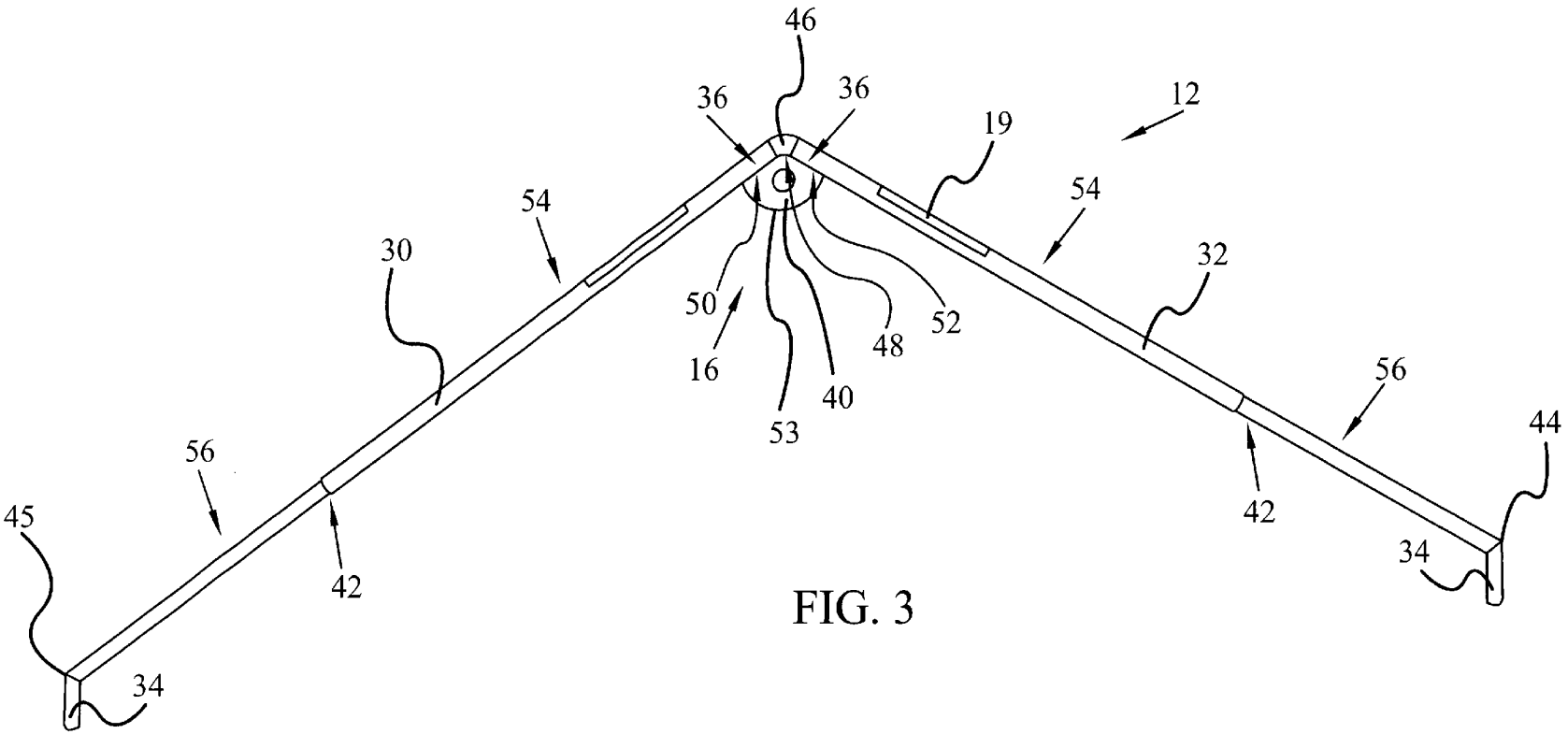
FIG. 3 is a front view of a support member of the present invention.

Referring now to FIGS. 1 and 3, support member 12 comprises a first leg 30 and a second leg 32. Each leg 30 and 32 has a first end 34 and a second end 36. Legs 30 and 32 are much longer in one dimension than they are in their other dimensions, meaning that legs 30 and 32, like center beam 14, are long rods that may be cylindrical in shape. Alternatively, legs 30 and 32 may have other configurations with cross sections that are, for example, triangular or square. First ends 34 are located distally from junction location 16, and may be angled away from the general line defined by legs 30 and 32 by virtue of an elbow 44. When elbows 44 are present, first ends 34 are measured from the extreme distal end of legs 30 and 32 to elbow 44, and may be of various lengths. First ends 34 may in another embodiment continue in the same general line defined by legs 30 and 32. This embodiment would obviously lack elbows 44.

Figure 5:
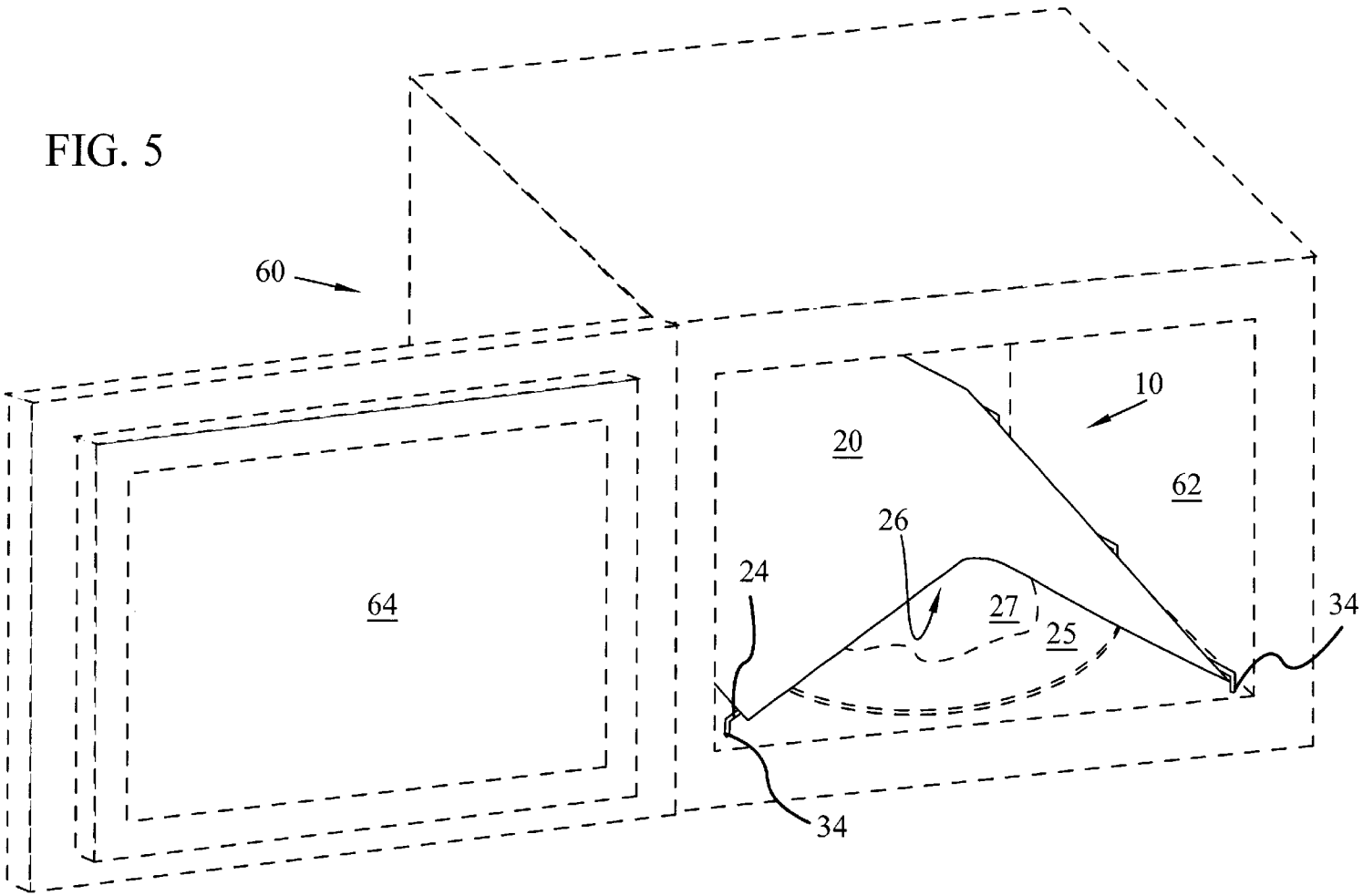
FIG. 5 is a view of the invention situated inside a microwave oven.

When elbow 44 is present in support members 12, first ends 34 are offset or angled away from the line defined by legs 30 and 32, as described above. First ends 34 may in this situation be oriented such that they run parallel to the side walls of a microwave oven when apparatus 10 is placed in the oven as shown in FIG. 5. This configuration is what is depicted in FIG. 3, and may serve at least two purposes. First, the length of first ends 34 may be varied according to the height above the microwave oven floor desired for apparatus 10. Second, the greater surface area that would come into contact with the side walls of the oven as a result of this construction would allow friction to be created between the side walls and apparatus 10 which would tend to reduce the possibility that apparatus 10 would slip or be inadvertently moved from its desired location in the oven. First ends 34 may be provided with a gripping material to maximize this effect if desired. First ends 34 could also be made to adjust in length, as further described below. Lines 45 indicate the locations at which this length adjustment may take place.

Second ends 36 of legs 30 and 32 come together at junction location 16, and legs 30 and 32 form an angle having a vertex 48. Legs 30 and 32 proceed away from vertex 48 in substantially straight lines. In one embodiment, junction location 16 includes an aperture 38 and a flap 40 as well as a cap 46. Aperture 38 may advantageously be of the same shape as that possessed by the cross section of center beam 14, and may be located at or near the center of flap 40. Cap 46 forms a bridge between second ends 36 of legs 30 and 32 and may be continuous with second ends 36, meaning second ends 36 and cap 46 may be molded out of a single piece of material, or cap 46 may be an insert fastened at either end to one or the other of second ends 36. It should here be understood that in another embodiment of support member 12, cap 46 may not appear at all. In that embodiment, second ends 36 may join to each other directly, may define a space between them, or may exhibit some other configuration in which second ends 36 are maintained in proximate relationship.

Center beam 14 contacts each support member 12 at junction location 16, thus giving stability and balance to support members 12 and structure to apparatus 10. In one embodiment center beam 14 is inserted through apertures 38 and support members 12 are positioned along the length of center beam 14. A useful arrangement is to locate support members 12 such that they are spaced approximately equidistant from each other, with the outermost support members 12 located at or near the extreme ends of center beam 14, although any other arrangement of support members 12 is possible. In an embodiment lacking apertures 38, center beam 14 may for example rest inside upturned hooks, not shown, that attach to support members 12. Many other configurations are also possible, as will be apparent to those of ordinary skill in the art.

The point where legs 30 and 32 come together defines vertex 48. Flap 40 fits into vertex 48 and extends a first distance 50 along first leg 30 and a second distance 52 along second leg 32. First distance 50 and second distance 52 may advantageously be approximately equal to each other. A bottom edge 53 of flap 40 extends from first leg 30 to second leg 32. Flap 40, first leg 30 and second leg 32 may be a continuous piece of material, or flap 40 may be a separate piece that is attached to legs 30 and 32 in a known manner that is suitable for the invention's intended uses as described herein. Flap 40 serves to stabilize and strengthen support members 12, and to provide a location for aperture 38. Its exact dimensions and shape are unimportant, and any one of many possibilities will suffice.

First leg 30 and second leg 32 include an adjustment location 42 located between first end 34 and second end 36. Adjustment location 42 divides legs 30 and 32 into an upper section 54 and a lower section 56. Adjustment location 42 may be located at any point between ends 34 and 36, but may advantageously be located distally from second end 36 at a distance such that apparatus 10 would fit inside the smallest commercially-available microwave oven if legs 30 and 32 ended at that distance and apparatus 10 were positioned in the intended fashion. Adjustment location 42 may comprise a line scored into the material of legs 30 and 32 to facilitate breakage of said legs, a location at which lower section 56 disappears inside of upper section 54 in a telescoping action, a hinge, or any other mechanism or means capable of changing the length of legs 30 and 32. In a manner similar to that described for adjustment location 42, first ends 34 may also be adjustable. Line 45 indicates the location at which this would be done.

Adjustment location 42 provides a way for legs 30 and 32 to be varied in length. Because there exist microwave ovens of various sizes, having differing interior volumes, the food containers these ovens accommodate also vary in size. These food containers, furthermore, come in a wide range of shapes and heights in addition to the range they manifest in terms of the area they take up on the floor of a microwave oven. Legs 30 and 32 are adjustable in length in order to accommodate this variety. When apparatus 10 is used in a small microwave oven, lower sections 56 may be retracted into upper section 54 of legs 30 and 32, resulting in an apparatus 10 that is able to fit inside the small appliance but fit over the smaller food containers that are appropriate for the space constraints. If apparatus 10 were later to be used in a larger microwave, perhaps in conjunction with a larger food container, lower sections 56 could be extended to produce an apparatus 10 large enough to fit over those containers. In another embodiment, lower section 56 may be broken off, and apparatus 10 permanently sized for a microwave of smaller size. It should here be noted that apparatus 10 may also be constructed with legs 30 and 32 that are of fixed length and non-adjustable.

Apparatus 10, as has been explained, is adjustable both in height and in terms of the area of the microwave oven's floor which it covers. This adjustability is useful not only because apparatus 10 may thus be used in microwave ovens and with food containers of various sizes, but also because apparatus 10 may thus be customized in terms of the distance from a food container at which it holds a covering 20, shown in FIG. 2, and in terms of the distance from the edge of a food container at which legs 30 and 32 are placed. For example, in a large microwave oven, which can accommodate food containers both large and small, apparatus 10 may normally be adjusted upwards in size so as to fit over the larger food containers which may possibly be used there. Yet when a smaller container is used therein, apparatus 10 may advantageously be adjusted downwards in size so as to be close to both top and sides of the smaller container. Such a downward adjustment may better prevent or reduce food splatters, for example. On the other hand, apparatus 10 may be adjusted upwards in size when used with a small food container if, for example, it were desirable to allow a greater amount of steam to escape from underneath covering 20 than would be possible if apparatus 10 were sized to fit more closely over the small food container.

In one embodiment of apparatus 10, support members 12 may be provided with a hinge or other mechanism allowing first leg 30 and second leg 32 to fold or swing about an axis located at or near junction location 16. In this embodiment, the hinge, not shown in the figures, may be provided with locking and releasing means that allow legs 30 and 32 to be locked into an open position while apparatus 10 is in use and released so legs 30 and 32 may be folded against each other when apparatus 10 is to be shipped, stored, cleaned, or otherwise idle.

Referring still to FIG. 1, holding devices 18 may be affixed to center beam 14 or support members 12 in any manner that would not preclude the use of apparatus 10 in a microwave oven. In one embodiment, holding devices 18 may be molded from the same piece of material as is center beam 14. Holding devices 18 may take the form of a clip or a clamp that opens to admit an edge 22 or corner of covering 20 and then close down securely on edge 22 thus holding covering 20 in place. Covering 20 is not shown in FIG. 1 but may be seen in FIG. 2. In another embodiment, holding devices 18 may open to admit a crease formed near the center of covering 20. Holding devices 18 may further advantageously consist of a double clip that opens on two sides so that one side may grip covering 20 while another side may simultaneously grip center beam 14 or another location on apparatus 10 where holding device 18 may be placed. This double clip mechanism would be useful with an embodiment of apparatus 10 wherein apparatus 10 may be disassembled because holding devices 18 may be too large to fit through apertures 38 and would thus prevent the removal of center beam 14 from some of support members 12 were holding devices 18 not removable. It should be understood, however, that permanently attached holding devices 18 are within the intended scope of the present invention in spite of the possibility that such an embodiment may lead to an apparatus 10 that could not be taken apart completely.

In one embodiment of apparatus 10, holding devices 18 are supplemented or replaced by friction surface 19. Friction surface 19 may be located along the top of a portion of legs 30 and 32, as shown for example in FIG. 3, or it may be located on or near cap 46. Yet another place at which friction surface 19 may be located is along some portion of center beam 14. Friction surface 19 is adapted to increase the friction between covering 20 and apparatus 10, thereby preventing or discouraging covering 20 from slipping from its intended place atop apparatus 10.

Friction surface 19 could advantageously be a rubberized material attached to apparatus 10 in an appropriate location as outlined above. It could also comprise a series of bristles such as those used in conjunction with velcro fasteners, a roughened section of, for example, legs 30 and 32, a rubberized sleeve adapted to be slipped over some portion of apparatus 10, or any other mechanism for increasing the friction between apparatus 10 and covering 20. FIG. 3 shows friction surface 19 as being located on the upper half of legs 30 and 32 of support member 12. Friction surface 19 could also, however, comprise the total surface area of a section of support member 12, or it could comprise any percentage of the surface area sufficient to increase the friction as mentioned above. Friction surface 19 could be located on any number of support members 12, or in any number of places along center beam 14. Of course, in certain embodiments of apparatus 12, friction surface 19 could be absent altogether. As stated above, friction surface 19 may appear in place of or in conjunction with holding devices 18.

Figure 2:
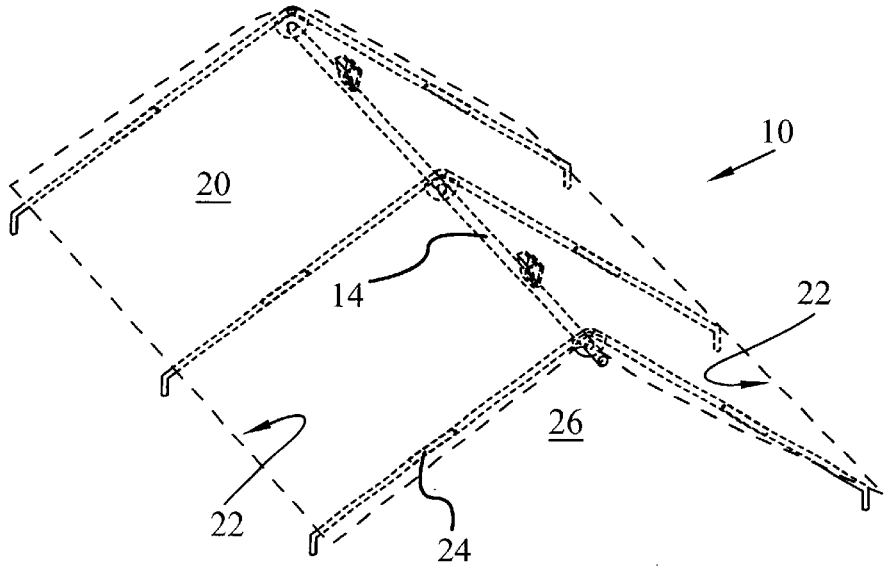
FIG. 2 is a perspective view showing the invention with a covering in place as described herein.

Referring now also to FIG. 2, and still to FIG. 3, covering 20 is shown draped over apparatus 10. Edge 22 of covering 20 is located near first ends 34 of legs 30 and 32. Front support member 24 defines an opening 26 through which food containers are moved while being positioned in the microwave oven for heating. It should be understood that front support member 24 differs from support members 12 only in position, i.e., only in that front support member 24 is located at an extreme end of center beam 14 and faces the door of the microwave oven. In its physical makeup and all other respects front support member 24 is substantially the same as the other support members 12, and any one of support members 12 could be used as front support member 24. The size of opening 26 is determined by the length of legs 30 and 32 and by the angle having vertex 48. The present invention is intended to include within its scope all such angles and leg lengths that make sense in the context of its intended use as set forth herein.

Covering 20, when suspended over a food container in a microwave oven using apparatus 10, functions to prevent or reduce food splatters that can result from the heating of water molecules inside the food. Covering 20 may also, depending on the distance at which it is placed from a food container, trap and hold a greater or lesser amount of steam close to the food container. A greater amount of steam held close to food being heated decreases the food's crispiness, while a lesser amount of steam increases crispiness. Covering 20 may advantageously be a paper towel, a napkin, or a similar paper product. Alternatively it could be a cloth towel, wax paper, a plastic product, or any item suitable for use in a microwave oven capable of containing food splatters or trapping steam. Paper products such as paper towels have the advantages of being disposable, inexpensive, appropriately sized, and readily available in most kitchens.

Figure 4:
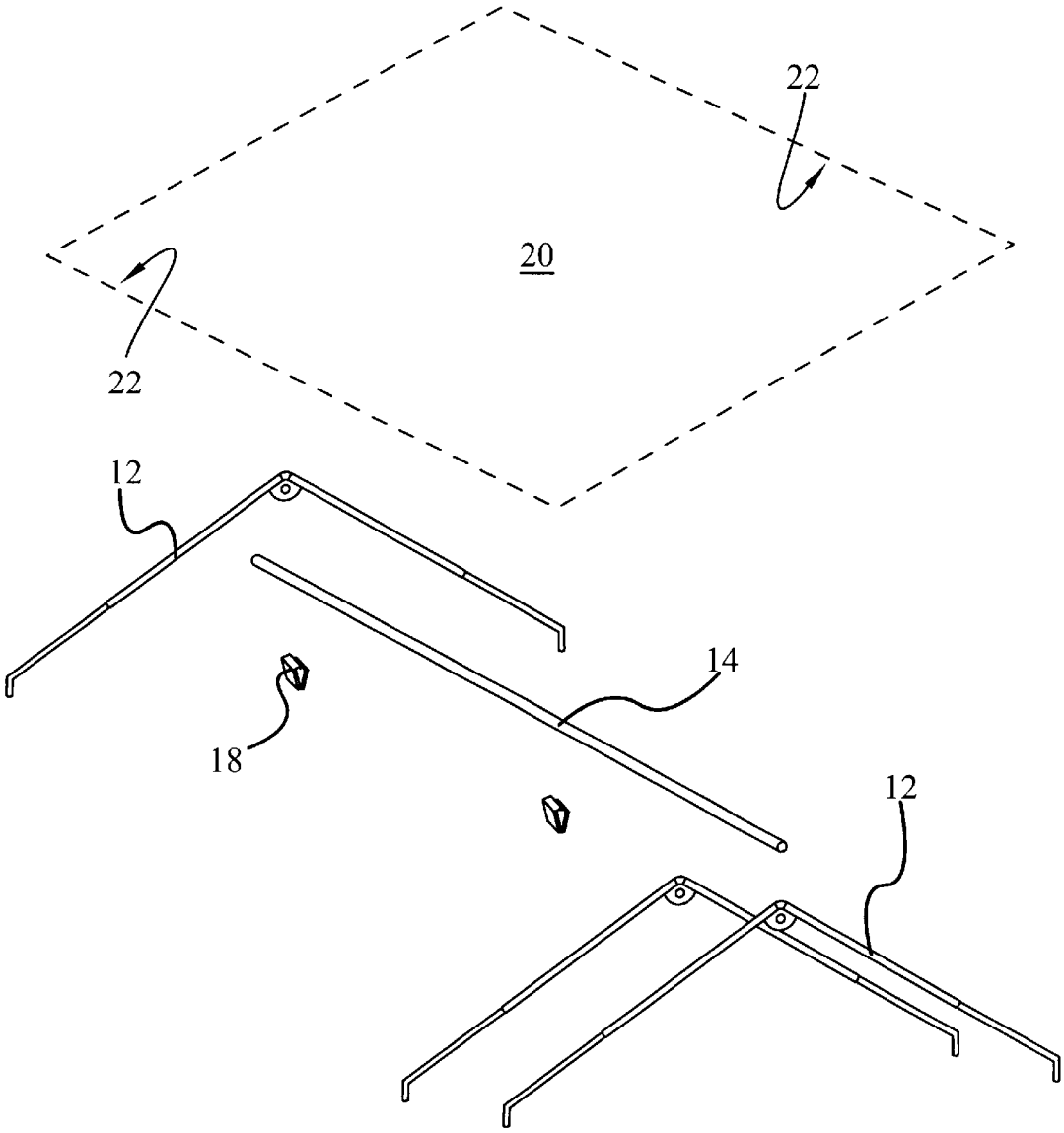
FIG. 4 is an exploded view of the invention showing its elements in disassembled form.

Referring now to FIG. 4, in addition to FIGS. 1–3, the various components of apparatus 10 are shown in disassembled relationship. All of the components, namely support members 12, center beam 14, holding devices 18, and covering 20 have been previously discussed. To assemble apparatus 10 from a disassembled condition like that shown in FIG. 4, center beam 14 is inserted through apertures 38 and support members 12 are spaced at appropriate intervals along the length of center beam 14. Holding devices 18 may then be attached either to center beam 14 or to support members 12 using any method known to those of ordinary skill in the art.

After support members 12 and holding devices 18 have been placed on center beam 14, covering 20 is draped over apparatus 10 such that covering 20 is centered substantially on center beam 14 and such that edges 22 fall at or near first ends 34 of legs 30 and 32. Covering 20 may then be secured in place with holding devices 18. Covering 20, of course, is a useful item when used in conjunction with apparatus 10 but does not constitute part of the invention and is shown in dashed lines in FIG. 4 to indicate this fact.

Taking apparatus 10 apart offers advantages in terms of storage, shipment, and cleaning, among other possibilities. Apparatus 10 in assembled form can be rather bulky but when taken apart is able to fit into a much smaller space, meaning it requires less room in a cupboard or on a counter top, in a shipping box, or in the sink when being cleaned. In an embodiment where first leg 30 and second leg 32 are provided with a hinge or other mechanism between them allowing them to swing towards each other about an axis located at or near junction location 16, apparatus 10 may be broken down into an even more compact unit when disassembled, increasing the advantages outlined above.

FIG. 5 depicts apparatus 10 inside a microwave oven 60 and positioned as it would ordinarily be positioned in the course of normal use, having covering 20 placed over support members 12 and center beam 14, not visible in the figure, with first ends 34 of legs 30 and 32 located near side walls 62 of microwave oven 60.

In use, apparatus 10 is positioned inside microwave oven 60 as shown, with covering 20 positioned also as shown, and a food container 25, such as a plate, dish, bowl, pan, or any other container suitable for holding food 27 in a microwave oven, is placed underneath apparatus 10 in opening 26 defined by front support member 24. The food container would typically be substantially centered underneath apparatus 10 such that the food would be uniformly covered by covering 20. After the food container is positioned as described, a microwave oven door 64 is closed and microwave 60 is operated in the usual manner, during which time apparatus 10, with covering 20, serves to prevent food splatters, retain or release steam close to the food container, and to operate in any or all of the ways set forth herein.

While the invention has been particularly shown and described with reference to specific embodiments thereof, it will be understood by those skilled in the art that various changes in form and details may be made therein without departing from the spirit and scope of the invention. Language to this effect has been used throughout the foregoing description, and should be understood to embrace an invention that may be broader in scope than the particular embodiments described.

I claim:

1. An apparatus adapted to suspend a covering over a container in a microwave oven, said apparatus comprising:

(1) a plurality of support members, said support members comprising a first leg and a second leg, said legs having a first end and a second end, wherein said first ends are maintained in a spaced apart relationship, said first ends contacting the floor of said microwave oven, wherein said second ends are maintained in a proximate relationship at a junction locations wherein said junction location further includes a flap of material, said flap fitting into said vertex of said angle, said flap extending a first distance along said first leg and extending a second distance along said second leg, said flap further having a bottom edge, said bottom edge extending between said first leg and said second leg, wherein said first leg intersects with said second leg, said first and second legs forming an angle, and wherein said junction location includes the vertex of said angle; and (2) a center beam, said center beam contacting said plurality of support members at said junction locations.

2. The apparatus of claim 1 wherein said angle is obtuse.

3. The apparatus of claim 1 wherein the length of said legs is adjustable.

4. The apparatus of claim 3 wherein said legs are adjusted such that said first ends of said first and second legs may be adjusted to define a distance therebetween determined by the width of said microwave oven.

5. The apparatus of claim 3 wherein said legs are adjusted such that said covering does not contact said container when said container is placed underneath said apparatus inside said microwave oven.

6. The apparatus of claim 1 wherein said first distance is substantially equal to said second distance.

7. The apparatus of claim 1 wherein said flap includes an aperture sized to permit the passage of said center beam, wherein said center beam may be removably inserted through said aperture.

8. An apparatus adapted to suspend a covering over a container in a microwave oven, said apparatus comprising:

(1) a plurality of support members, said support members comprising a first leg and a second leg, said legs having a first end and a second end, wherein said first ends are maintained in a spaced apart relationship, said first ends contacting the floor of said microwave oven, wherein said second ends are maintained in a proximate relationship at a junction location;

(2) a center beam, said center beam contacting said plurality of support members at said junction locations; and (3) a clip to retain said covering on said apparatus.

9. The apparatus of claim 8 wherein said holding device comprises means for increasing the friction between said covering and said apparatus.

10. An apparatus adapted to suspend a covering over a container in a microwave oven, said apparatus comprising:

(1) a plurality of support members, said support members comprising a first adjustable leg and a second adjustable leg, said adjustable legs having a first end and a second end wherein said first ends are maintained in a spaced apart relationship, said first ends contacting the floor of said microwave oven, and wherein said second ends intersect and form an obtuse angle at a junction location, said junction location further including a flap of material, said flap fitting into said vertex of said angle, said flap extending a first distance along said first adjustable leg and extending a second distance along said second adjustable leg, said flap further having a bottom edge, said bottom edge extending between said first leg and said second leg, said first distance being substantially equal to said second distance, said flap including an aperture;

(2) a center beam adapted to be removably inserted through said aperture, said center beam contacting said plurality of support members at said apertures in said junction locations; and (3) a holding device adapted to secure said covering to said apparatus.

11. The apparatus of claim 10 wherein said holding device is a clip.

12. The apparatus of claim 10 wherein said holding device comprises means for increasing the friction between said covering and said apparatus.

13. A method for using an apparatus adapted to suspend a covering over a container in a microwave oven, said method comprising the steps of:

(1) providing an apparatus comprising:

(a) a plurality of support members, said support members comprising a first leg and a second leg, said legs having a first end and a second end wherein said first ends are maintained in a spaced apart relationship, said first ends contacting the floor of said microwave oven, and wherein said second ends are maintained in a proximate relationship at a junction location; and (b) a center beam, said center beam contacting said support members at said junction locations;

(2) positioning said apparatus in said microwave oven;

(3) placing a covering over said apparatus such that said covering rests over the top of said support members and said center beam;

(4) positioning said container in said microwave oven underneath said apparatus such that said covering is suspended over the top of said container; and (5) operating said microwave oven to heat the contents of said container.

* * * * *

UNITED STATES PATENT AND TRADEMARK OFFICE

CERTIFICATE OF CORRECTION

PATENT NO. : 6,734,407 B1
DATED : May 11, 2004
INVENTOR(S) : Abbott

It is certified that error appears in the above-identified patent and that said Letters Patent is hereby corrected as shown below:

Column 7, line 67 - Column 8, line 3,
Claim 1 should read: -- ...wherein said second ends are maintained in a proximate relationshipat a junction location, wherein said junction location further includes… --

Signed and Sealed this

Sixth Day of July, 2004

JON W. DUDAS
*Acting Director of the United States Patent and Trademark Office*